United States Patent [19]

Lane

[11] 4,239,167

[45] Dec. 16, 1980

[54] WALL-MOUNTED EYEGLASS HOLDER

[76] Inventor: G. William Lane, 2555 Cherryridge Rd., Englewood, Colo. 80110

[21] Appl. No.: 5,684

[22] Filed: Jan. 23, 1979

[51] Int. Cl.[3] ..... E04G 3/00

[52] U.S. Cl. ..... 248/205 A; 248/DIG. 2

[58] Field of Search ..... 248/205 A, DIG. 2, 314, 248/315, 467

[56] References Cited

U.S. PATENT DOCUMENTS

| | | | |
|---|---|---|---|
| 2,102,690 | 12/1937 | Fischer | 248/205 A |
| 2,368,838 | 2/1945 | James | 248/205 A |
| 3,101,869 | 8/1963 | Baker | 248/205 A |
| 3,123,208 | 3/1964 | Barnum et al. | 248/DIG. 2 |
| 3,810,596 | 5/1974 | Elm | 248/205 A |
| 3,825,214 | 7/1974 | Ciolfi | 248/314 |
| 3,946,877 | 3/1976 | Galicia | 248/205 A |

*Primary Examiner*—Francis K. Zugel

*Attorney, Agent, or Firm*—John E. Reilly

[57] ABSTRACT

A holder for supporting a pair of eyeglasses is provided wherein a support bracket is formed out of a flexible body panel with the support bracket being a substantially rigid arch defining a vertically extending opening which is sized to permit insertion of a temple piece of the eyeglass so that the pivotal connection between the temple piece and the frame rests on the arched support bracket thereby suspending the glasses by securing them to an upright surface to which the holder is attached.

6 Claims, 8 Drawing Figures

WALL-MOUNTED EYEGLASS HOLDER

BACKGROUND OF THE INVENTION

Persons who wear eyeglasses often have difficulty in locating their glasses after not wearing them for any length of time. In any case, it is desirable to provide a readily accessible holder for placing or storing eyeglasses which will avoid loss or damage when the glasses are not in use. Characteristically, a pair of glasses are made up of a frame supported on the bridge of the nose to which right and left temple pieces are attached to extend along the side of the wearer's head to a point past the ears so that the cooperation between the support of the bridge of the nose and ears maintains the eyeglass frame in place with the lenses positioned directly in front of the eyes. It is therefore necessary that a suitable holder be adapted to this particular construction.

Although glass cases have been developed to encase the eyeglass frames, many persons do not elect to utilize such cases and instead, merely place their eyeglasses in some accessible location. The problem with this approach, however, is that one's eyeglasses may become misplaced or lost. Yet another problem results since the eyeglasses may be damaged if objects are placed on them or the glasses are knocked away from their location and fall and break. Further, when the glasses are placed in an unprotected location, they are subject to being scratched either by other items or even by the surface on which the eyeglasses are placed.

Several attempts in the past have been directed to providing an eyeglass holder which will provided a convenient location for placing a wearer's eyeglasses so as to protect them from damage in a convenient location. One such attempt is described in U.S. Pat. No. 2,997,270 to Farndon, issued Aug. 22, 1961, wherein a rack for spectacles is provided, which rack slidingly mounts onto a wall-mounted bracket and which provides a flat horizontal surface to support the lens frame with the temple pieces extending in a downward direction. A plurality of guard fingers retain the glasses in position and protect the lens surfaces.

Another attempt to provide a support holder for eyeglasses is disclosed in U.S. Pat. No. 3,259,348 to Dann, issued July 5, 1966. In this patent, a support bracket comprising a block formed of yieldable material is mounted to a wall and this block has a narrow neck portion which receives the nose pieces of an eyeglass frame with the temple pieces being in a folded configuration so that they cross above the narrow neck of the notched block.

Both of these devices, however, project a substantial distance from the wall and glasses placed thereon may be quite susceptible to being jarred or knocked off of their mounting support. There is therefore a need to provide a holder which is mountable in a vertical disposition to allow loose insertion of a portion of the glasses, such as the temple pieces, so that the glasses will be freely, yet securely suspended in a readily accessible location.

As should readily be appreciated, a substantially rigid support member or loop would have advantages in allowing free or loose insertion and removal of a portion of the eyeglasses. Even though prior mounts for eyeglasses have utilized elastic loops to secure eyeglass frames for storage or shipment, these loops do not provide the convenience in use as does a rigid support bracket, particularly when used in conjunction with the temple piece of the eyeglasses. Indeed, should the elastic loop be large in diameter, the temple piece might slip out of the loop because of the loop's flexibility. Should the loop be small so as to avoid slippage, it would present problems of insertion of the temple piece due to its reduced size. Also, the elastic band, if placed around the eyeglass frame and temples, could, if the restorative force were substantial, cause a gradual bending of the temple pieces out of proper adjustment. These disadvantages would be removed by providing a rigid, vertically opening support bracket.

SUMMARY OF THE INVENTION

It is an object of the present invention to provide a novel and improved eyeglass holder including a rigid support bracket adapted to be mounted to a generally upright surface and which will simply and effectively support a pair of glasses.

Another object of the present invention is to provide an eyeglass holder which can receive a temple piece of a pair of eyeglasses so as to support the eyeglasses by means of the pivotal connection between the temple and frame thereof whereby the mounting bracket protrudes minimally from the support surface.

Yet another object of the present invention is to provide a substantially rigid arch-like band forming a support bracket which is constructed out of a generally flexible, substantially planar body panel which support bracket is sized to have an opening permitting insertion of a temple piece of a pair of eyeglasses for supporting them at the pivotal connection between the temple piece and the eyeglass frame and which holder will be readily attachable to a selected surface.

A further object of the present invention is to provide a holder for a pair of eyeglasses in which a substantially rigid support bracket is formed integrally with a substantially flexible, flat body panel which support bracket is offset from the center of the panel and sized to receive a portion of the eyglasses so that, when mounted on an upright surface, the center of the body panel is above the support bracket so that the panel is subjected to tension forces rather than torque forces about its center.

It is still a further object of the present invention to provide a holder sized for receiving eyeglass temple pieces of different sizes To accomplish these objects, the preferred form of the present invention provides an eyeglass holder for supporting a pair of eyeglasses composed predominantly of a flat, flexible body panel out of which is formed a substantially rigid support bracket in the form of an arch spaced in front of the body panel so that, when mounted on an upright surface, the support bracket defines a vertically extending opening. The opening is sized to permit free insertion of the temple of a pair of eyeglasses so that it may support the eyeglasses at the pivotal connection between the temple and the frame when this pivotal connection rests on the support bracket and can receive temples of different sizes. For this reason, the support bracket, and hence the body panel, is sufficiently thin to provide clearance so that the temple piece may be folded against the frame after insertion of the temple piece through the opening. Means for attaching the holder to an upright surface is also provided.

The invention, in the form of the preferred embodiment, also provides a backing strip on the side of the body panel opposite the support bracket to protect the surface to which the holder is attached. Since the support bracket is formed out of the flat body panel, a window or aperture results in the body panel behind the arched support bracket. The backing strip covers this window so that no portion of the upright surface behind the body panel is exposed. Further, in forming the support bracket, the substantially rigid characteristic is achieved by constructing this support bracket as an arch having convergent sidewalls which are bridged by a top wall portion with this top wall portion being of generally inverted V-shaped configuration. In the alternate embodiment, a pair of support brackets substantially as described are formed out of a common body panel so that these support brackets may simultaneously receive the temple pieces of two different pair of eyeglasses.

Other objects, advantages and features of the present invention will become more readily apparent when taken together with taken together with the accompanying drawings in which:

DETAILED DESCRIPTION OF THE PREFERRED EMBODIMENT

Figure 1:
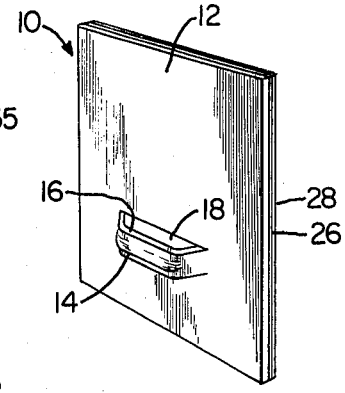
FIG. 1 is a perspective view of the preferred embodiment of the eyeglass holder of the present invention.
Figure 5:
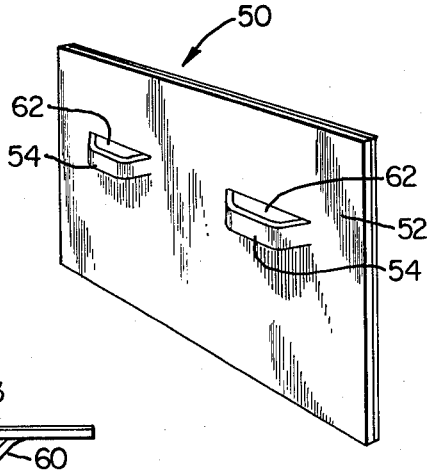
FIG. 5 is a perspective view of an alternative embodiment of the present invention.
Figure 7:
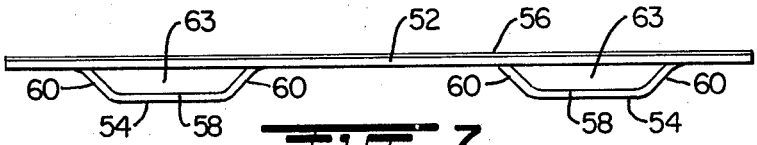
FIG. 7 is a top plan view of the alternate embodiment shown in FIG. 5.
Figure 6:
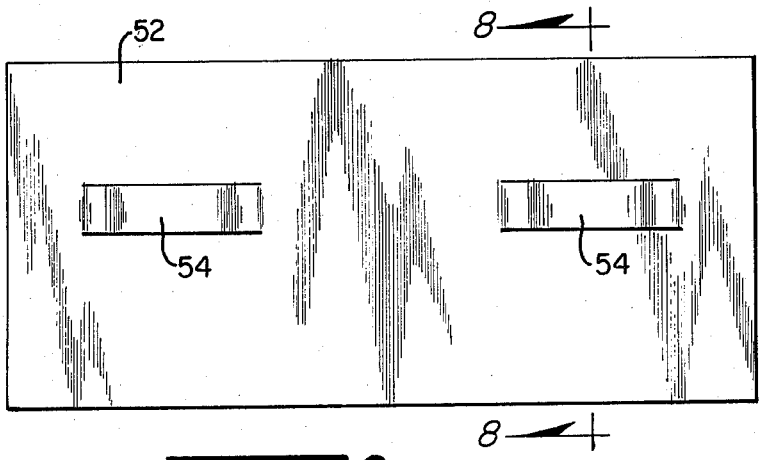
FIG. 6 is a front view in elevation of the alternate embodiment shown in FIG. 5.
Figure 8:
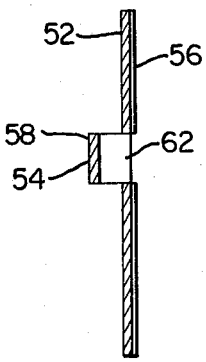
FIG. 8 is a cross-sectional view of the alternate embodiment taken along line 8—8 of FIG. 6.

The preferred embodiment of the present invention is directed to providing a holder for a pair of eyeglasses and the like which is adaptable to be mounted on a generally upright surface. As shown in FIG. 1, eyeglass holder 10 has a main backing member or body panel 12 and a support bracket 14.

Figure 4:
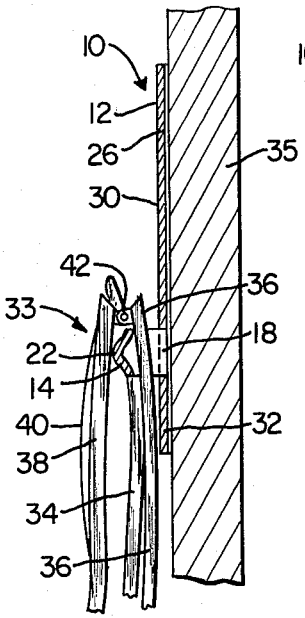
FIG. 4 is a cross-sectional view taken along lines 4—4 of FIG. 2.

Eyeglass holder 10 is constructed to be mounted upon an upright surface and to receive a portion of a pair of eyeglasses as shown in FIG. 4. As is well known, a pair of eyeglasses has a frame 38 which receives left and right lenses and a left temple piece 34 and a right temple piece 36, which mount at some portion of the lens-receiving frame and are configured to extend along the wearer's head so that the glasses are positioned and retained in front of the person's eyes by means of nosepieces on the front frame which rest on the bridge of the nose and the ear pieces at the rear of the temples. Support bracket 14 of holder 10 is sized to receive one of the temples of the pair of glasses so that it may be inserted therethrough after which the temple pieces may be folded onto the front frame and the bracket will support the glasses at the pivotal connection between the selected temple and the frames. In the preferred embodiment, upper edge 16 of support bracket 14 so supports the pivotal connection or hinge 42 and hence the eyeglasses.

The construction of the preferred embodiment can be seen in more detail with reference to FIGS. 1–4. Specifically, body panel 12 is of substantially flat construction and is formed of a flexible material such as a plastic. Support bracket 14 is formed out of body panel 12, but is configured so that it has substantial rigidity as will hereinafter be described. By forming support bracket 14 out of body panel 12, it should be appreciated that a generally rectangular window 18 is formed in body panel 12 by the removal of the material forming the support bracket 14. Holder 10 is constructed so that when attached to an upright surface, support bracket 14 is horizontal so that it defines a generally vertical opening 20 between top wall 22 of support bracket 14 and window 18. Further, support bracket 14 has a pair of sidewalls 24 which converge as they project outwardly from body panel 12 in a curved arc to meet top wall 22. Top wall 22 is then generally parallel to the plane of body panel 12.

In the preferred embodiment, a backing strip 26 is secured to the surface of body panel 12 opposite support bracket 14 and is preferably dimensioned to be the same size as body panel 12 Preferably, backing strip 26 is a thin strip of paper or paper-like material which temporarily covers an adhesive layer 28 placed on the surface of the panel 12 so that when the backing strip is removed the holder 10 may be supported by securing the adhesive layer to the attachment surface.

Figure 3:
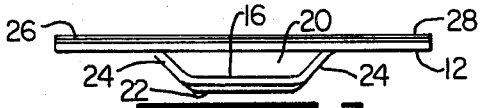
FIG. 3 is a top plan view of the support bracket shown in FIG. 1.
Figure 2:
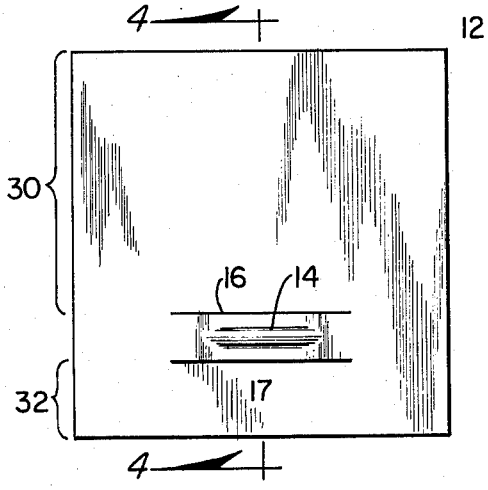
FIG. 2 is a front view in elevation of the eyeglass holder shown in FIG. 1.

FIG. 2 shows the orientation of mounting bracket 14 on body panel 12, and it should be appreciated that support bracket 14 is constructed of a narrow, elongated band or strip which extends horizontally when holder 10 is attached and is offset from the cener of body panel 12. In this manner, then, support bracket 14 generally divides body panel 12 and the two panel portions 30 and 32 which, when holder 10 is mounted, are above and below bracket 14, respectively. Panel portion 30 is much larger in area than panel portion 32, for a purpose explained more fully below.

FIG. 4 shows holder 10 mounted against a vertical surface 35 with a pair of glasses supported by bracket 14. As may be seen in FIG. 4, an outer reinforcing wall of bracket 14 is preferably formed by forming or crimping an intermediate portion into a generally wedge shaped or inverted V-shaped cross-sectional configuration with respect to body panel 12. As mentioned above, support bracket 14 is formed out of the flexible material of body panel 12, but, by providing this wedge-shaped configuration, substantial rigidity or reinforcement is obtained for the support bracket 14.

A standard pair of eyeglasses 33 is supported by bracket 14 in FIG. 4, and it should be appreciated that glasses 33 have left and right temple piece 34 and 36, respectively, and a main frame 38 which carries lens 40. Right temple 36 is pivotally connected to main frame 38 by means of hinge 42. It should be appreciated that main frame 38 carries a second lens and that left temple 34 is hinged to main frame 38 although these features are not shown in FIG. 4 but are standard among ordinary eyeglasses. As a result of the thickness of hinge 42 and the construction of right temple 36 and main frame 38, space 44 is formed in the configuration of eyeglasses 33. It is important that the thickness of support bracket 14 be such that it may be positioned within space 44 with the left and right temple pieces 34, 36 folded together. Hence, the thickness of body panel 12 should be sufficient so that when support bracket 14 is formed it will be this dimension.

To support eyeglasses 33 by means of support bracket 14, support bracket 14 must be of such dimension as to receive one of the temple pieces of eyeglasses 33. Further, it has been found convenient to make the base of support bracket 14 wider than that of top wall 22 since it is desirable for sidewalls 24 to converge outwardly of body panel 12. By so dimensioning support bracket 14, one of temple pieces 34, 36 may be conveniently inserted in opening 20. Specifically, it has been found suitable to provide a body panel having a thickness of approximately 1 millimeter and forming support bracket 14 as a substantially rigid arch approximately 0.5 centimeters high. Further, it has been found suitable to manufacture a holder 10 so that support bracket 14 has a width of approximately 2 centimeters at its base adjacent window 18 and approximately 1.5 centimeters adjacent its top wall 22.

While other dimensions may be utilized, it is believed that these dimensions maximize the strength of support bracket 14 while allowing sufficient space to conveniently insert the end of one of temple pieces 34 and 36 opposite its respective hinge. This sizing also allows free insertion of eyeglass temple pieces of different sizes and configurations.

As mentioned above, panel portion 30 is larger than panel portion 32 and is adapted to be positioned above support bracket 14 when holder 10 is mounted to a support surface. By so constructing holder 10 so that support bracket 14 is offset from the center of body panel 12, the forces exerted on body panel 12 by a pair of eyeglasses 33 are predominantly tension forces rather than torque forces. This is because eyeglasses 33 will exert forces tending to pull body panel 12 away from its support surface 34 if the support bracket 14 were mounted at the center of body panel 12 or vertically upward thereof. Hence, there would be torque forces about the center of body panel 12. On the other hand, by positioning the support bracket 14 toward the lower portion of body panel 12, the forces exerted on body panel 12 are substantially parallel to support surface 34 so that body panel 12 is in tension rather than in torque. This is a more desirable configuration also since the strength of the adhesive layer 28 is stronger in this direction, as is well understood in the art.

FIGS. 5–8 show an alternate embodiment of this invention which shows a holder 50 adapted to mount two different pairs of eyeglasses. Eyeglass holder 50 is formed out of a body panel 52 and a pair of support brackets 54 are provided in a similar manner to that described with respect to the preferred embodiment. Specifically, support brackets 54 are each formed out of the material of body panel 52 so that each forms a substantially rigid arch projecting and spanning a respective window 62 formed by the removal of the material that forms the support brackets 54. Support brackets 54 define vertically extending openings 63 which are in side-by-side relationship, each of which is adapted to receive the temple piece of a pair of eyeglasses. Support brackets 54 each have a forward or outer wall 58 and a pair of sidewalls 60 with the sidewalls 60 for each bracket converging as it projects away from body panel 52 toward the wall 58 in the manner described with respect to the preferred embodiment. Adhesive layer 56 is placed on body panel 52 opposite support brackets 54. It should be noted that in this alternate embodiment, no backing strip such as backing strip 26 is provided and described, however, it should be understood that a backing strip could readily be secured to body panel 52 with the adhesive layer beng provided on top of the backing strip so that the backing strip would be sandwiched between the adhesive layer and the body panel 52. For this alternate embodiment, it is important that support brackets 54 be longitudinally aligned, that is, positioned so that the walls 58 are generally horizontally in line with one another.

Much of the description with respect to the preferred embodiment above also pertains to the alternate embodiment shown in FIGS. 5–8. Although not shown, the wall 58 could be constructed as a wedge or V to lend additional rigidity reinforcement to its construction. Also, as previously mentioned, a backing strip could be provided for body panel 52. In fact, a backing strip is preferable since, upon mounting the holder to a support surface, the backing strip prevents dirt or grime from becoming built up in windows 62 and the backing strip further provides a protective covering for the support surface.

By constructing both the preferred embodiment and the alternate embodiment out of body panels having a substantially flexible charactristic, they may be attached to any generally upright surface such as a wall or the dashboard of a vehicle. Indeed, the present invention may be utilized in a variety of circumstances so as to provide a convenient storage location for eyeglasses so that the wearer may easily locate his eyeglasses if the present device is utilized. Further, the present device protects the lenses of a pair of eyeglasses by positioning the lenses in suspended relation to the support surface so that there is less tendency for them to become scratched or marred by that surface. Further, the present invention allows a pair of eyeglasses to be releasably retained so that they may not be readily jarred or knocked off of their support surface thereby being subjected to damage or breakage.

Although the present invention has been described with particularity relative to the foregoing description of preferred and alternate embodiments, various modifications, changes, additions and changes other than those mentioned herein will be readily apparent to those having normal skill in the art without departing from the spirit and scope of this invention.

I claim:

1. In an eyeglass holder adapted for supporting a pair of eyeglasses on a flat surface wherein a pair of eyeglasses have a lens frame and temple bars pivotally connected to opposite sides of said frame, the improvement comprising:

a substantially planar body panel;

holder-securing means on one surface of said body panel adapted for supporting said body panel on a flat surface; and a substantially rigid support bracket in the form of an arch projecting forwardly away from the plane of said body panel and defining a temple bar-receiving opening between said arch and said body panel sized to permit free insertion of one of said temple bars of said eyeglasses therethrough until the pivotal connection between the temple piece and the frame engages said support bracket with said frame facing away from said body panel, said arch provided with eyeglass supporting means in the form of a reinforcing portion of generally V-shaped cross-sectional configuration extending lengthwise of said arch in spaced, substantially parallel relation to said body panel.

2. In the eyeglass holder according to claim 1, wherein said body panel is adapted to be secured to a generally upright surface, and said support means includes an adhesive substance on a surface of said body panel opposite said support bracket for adhering said body panel to said upright surface.

3. In an eyeglass holder according to claim 1, wherein said support bracket is offset from the center of said body panel and said reinforcing portion is defined by deforming an intermediate portion of said arch into a generally V-shaped cross-sectional configuration.

4. In an eyeglass holder according to claim 1 wherein said support bracket is defined by a narrow elongated band formed out of said body panel so as to leave an open window therein, said band spanning said window, a backing strip secured to said body panel on a surface opposite said support bracket, and said attachment means being an adhesive layer on the surface of said body panel opposite said support bracket.

5. In an eyeglass holder according to claim 1, wherein said support bracket has said reinforcing portion extending substantially parallel to the plane of said body panel along its longitudinal dimension, said reinforcing portion positioned between the frame and a temple piece of said eyeglasses adjacent said pivotal connection when said temple piece is folded against said frame, said support bracket including a pair of sidewalls convergent away from said body panel into said reinforcing portion.

6. An eyeglass holder adapted for mounting on a flat surface comprising in combination:

a plurality of pairs of eyeglasses each having a lens-receiving frame and left and right temple pieces each pivotally connected to said frame at a corner thereof; and a substantially planar body panel, and a plurality of support brackets oriented in side-by-side relationship to one another, each said support bracket being a substantially rigid arch with an intermediate reinforcing portion of substantially v-shaped cross sectional configuration formed out of said body panel, said arches being longitudinally aligned and projecting out of the plane of said body panel to define a plurality of openings parallel to said body panel, each arch sized to receive a respective temple piece of one of said pairs of eyeglasses such that said frames are retained in suspended relation to each said support bracket with said lenses spaced in front of said body panel.

* * * * *

UNITED STATES PATENT AND TRADEMARK OFFICE

CERTIFICATE OF CORRECTION

PATENT NO. : 4,239,167

DATED : December 16, 1980

INVENTOR(S) : G. William Lane

It is certified that error appears in the above—identified patent and that said Letters Patent is hereby corrected as shown below:

In the Specification:

Column 1, line 33, cancel "provided" and substitute -- provide --.

Column 3, line 22, cancel "with taken together"

Column 4, line 35, cancel "cener" and substitute -- center --.

Column 6, line 24, cancel "charactristic" and substitute -- characteristic --.

Signed and Sealed this

Tenth Day of March 1981

[SEAL]

Attest:

RENE D. TEGTMEYER

Attesting Officer

Acting Commissioner of Patents and Trademarks